US006814047B2

(12) United States Patent
Vogel et al.

(10) Patent No.: US 6,814,047 B2
(45) Date of Patent: Nov. 9, 2004

(54) METHOD OF IGNITION AND CORRESPONDING IGNITION UNIT

(75) Inventors: Manfred Vogel, Ditzingen (DE); Werner Herden, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/312,937

(22) PCT Filed: Apr. 5, 2001

(86) PCT No.: PCT/DE01/01317

§ 371 (c)(1),
(2), (4) Date: Mar. 25, 2003

(87) PCT Pub. No.: WO02/02923

PCT Pub. Date: Jan. 10, 2002

(65) Prior Publication Data

US 2003/0154954 A1 Aug. 21, 2003

(30) Foreign Application Priority Data

Jun. 30, 2000 (DE) ..... 100 31 875

(51) Int. Cl.[7] ..... F02B 17/00; F02P 3/05
(52) U.S. Cl. ..... 123/295; 123/637
(58) Field of Search ..... 123/295, 305, 123/606, 609, 611, 620, 636, 637, 644

(56) References Cited

U.S. PATENT DOCUMENTS 4,212,280 A * 7/1980 Fresow et al. ..... 123/611
5,170,760 A 12/1992 Ishibashi et al. ..... 123/265
5,476,084 A * 12/1995 Morganti et al. ..... 123/637
5,553,594 A * 9/1996 Ehlers et al. ..... 123/609
5,754,011 A * 5/1998 Frus et al. ..... 315/209 SC
5,979,397 A * 11/1999 Machida et al. ..... 123/295
6,085,733 A * 7/2000 Motoyama et al. ..... 123/636
6,167,875 B1 * 1/2001 French et al. ..... 123/606
6,176,215 B1 * 1/2001 Baur et al. ..... 123/295

FOREIGN PATENT DOCUMENTS

| | | |
|---|---|---|
| EP | 0 281 528 | 9/1988 |
| EP | 0 919 714 | 6/1999 |
| WO | WO 97 48891 | 12/1997 |

* cited by examiner

*Primary Examiner*—Tony M. Argenbright
(74) *Attorney, Agent, or Firm*—Kenyon & Kenyon

(57) ABSTRACT

The present invention provides an ignition method for an internal combustion engine, an injection being alternatively performed in at least one first operating mode or in a second operating mode, and the ignition coil being charged as a function of the current operating mode. A control-pulse curve characteristic of the current operating mode is provided, and the charging of the ignition coil is performed by a control logic element in response to the control-pulse curve, using corresponding, different time characteristics of the primary current. The present invention also provides a corresponding ignition device for an internal combustion engine.

6 Claims, 2 Drawing Sheets

METHOD OF IGNITION AND CORRESPONDING IGNITION UNIT

FIELD OF THE INVENTION

The present invention relates to an ignition method for an internal combustion engine, an injection being alternatively performed in at least one first operating mode or in a second operating mode, and the ignition coil being charged as a function of the current operating mode; and the present invention relates to a corresponding ignition device.

Although applicable to any fuels and engines of any vehicles, the present invention and the problem on which it is based are explained with reference to a direct gasoline-injection system of an engine of a passenger car.

BACKGROUND INFORMATION

FIG. 4 illustrates the dependence of torque M on engine speed N for different operating modes of an internal combustion engine.

During so-called homogeneous, normal operation H1 of the direct gasoline-injection system, the entire combustion chamber is homogeneously filled with a stoichiometric air-fuel mixture (lambda value $\lambda=1$), which is ignited by the ignition sparks at the ignition firing point. In this case, there may be no ignition problems at all when the mixture has a high energy density.

However, homogeneous operation may also be realized in a lean manner and/or with exhaust-gas recirculation (EGR) as homogeneous operation H2. In this case, a high level of flow may be required in order to achieve sufficiently rapid burning in the case of low energy densities of the mixture in the combustion chamber. This may deflect the spark plasma, until it breaks away and reignition occurs.

In this manner, the spark energy during coil ignition may be distributed with typical spark durations of approximately 1 ms under these conditions, to numerous, subsequent sparks, which each reach new mixture regions.

But since the leanest operation or so-called high-EGR operation may only be attained when the entire energy of the ignition coil is introduced into a single flame core, all of the energy stored in the ignition coil may be required therefore to be supplied in such a short time that the spark still does not break away within this span of time (such as, for example, approximately 0.3–0.6 ms.).

This may yield a demand for as high an energy as possible and a very short spark duration (approximately 0.3–0.6 ms) for this H2 operation, which may result in a high, required initial current of 150–200 mA.

In order to make use of the fuel-consumption features with internal combustion engines having direct gasoline injection, so-called charge stratification may be implemented in the combustion chamber in certain operating ranges, which is referred to below as stratified-charge operation S.

During stratified-charge operation S, only a small, locally ignitable stoichiometric cloud is introduced into the combustion chamber, whereas the remaining contents of the combustion chamber may not be ignited. A feature of this stratified-charge operation S may include that the lean-combustion operation of the engine is extended, and fuel may therefore be saved in the end. Therefore, it may be desirable to configure the operating range of stratified-charge operation S to be as large as possible, and in particular, to therefore expand it to loads and engine speeds that are as high as possible.

During stratified-charge operation S, marked local and/or temporal lambda fluctuations may be present at the location of the ignition spark, when the average energy density in the mixture cloud is high. In order to achieve reliable ignition in this case, the spark should burn for a long time (such as, for example, approximately 5–10° KW (KW=crank angle)), so that within this time, the formation of the flame core may be started when a flammable mixture region is seized by the spark plasma.

In this context, depending on the flow of the mixture at the spark plug, only a continuously decreasing portion of the electrical energy introduced from the ignition coil may be available for forming the flame core as the spark duration increases. Thus, the conventional proposal may generate a pulse train, i.e. to repeatedly charge and discharge the ignition coil, within the above-mentioned KW interval.

Therefore, an individual ignition spark that burns as along as possible with an initial current of, for example, approximately 50–80 mA and a secondary energy of, for example, approximately 80–100 mJ, or an adjustable-length pulse train with an initial current of, for example, approximately 100 mA from a coil having, for example, approximately 30 mJ of secondary energy, may be suitable for this stratified operating mode.

Since the demands for stratified S and homogeneous H1 and H2 operating ranges may therefore be markedly different, a conventional system configuration having individual sparks may create a conflict of aims, which may have previously only been approached as a compromise. An ignition coil may either be configured for a long spark duration (high secondary inductance, i.e. high number of secondary windings per unit length) with a moderate initial current, or for a short spark duration (low secondary inductance, i.e. low number of secondary windings per unit length). Therefore, a decision for a discrete configuration as a compromise may be essential.

SUMMARY OF THE INVENTION

In contrast to the conventional configuration approaches, an exemplary ignition method and/or exemplary ignition device of the present invention may provide that a functionality adapted to the problem of direct gasoline-injection engines may allow optimum ignition in stratified operation, as well as in homogeneous lean-combustion operation and/or with EGR, and in cold starting or other critical engine conditions.

The operating mode may be controlled as required. Only the amount of energy required for ignition may be introduced. This may prevent spark-plug wear.

A smaller space for the coil due to a smaller number of turns per unit length on the secondary side, or a larger iron cross section, may be provided in the same space. Therefore, a cost advantage may be attained by dispensing with the magnets for pre-magnetizing the iron circuit.

The type of ignition suitable for the specific operating mode may be provided by control-pulse coding. For example, a pulse-train ignition suitable for stratified operation may be combined with the option of loading the ignition coil with a markedly higher amount of energy during homogeneous operation by increasing the primary current, so that it still discharges as a single spark within the desired spark duration of approximately 0.3–0.6 ms.

According to a further exemplary refinement, the first operating mode may be a homogeneous, normal operation, which may be divided up into the submodes of stoichiometric normal operation and sub-stoichiometric normal operation, and the second operating mode may be an inhomogeneous stratified-charge operation.

According to a further exemplary refinement, the charging of the ignition coil during inhomogeneous, stratified-charge operation may be performed in the form of pulse-train ignition with a predetermined primary current, and the charging of the ignition coil during homogeneous operation may be performed in the form of a single-pulse ignition with an increase in the primary current.

According to a further exemplary refinement, the control-pulse curves characteristic of the current operating mode may have different pulse times and/or numbers of pulses. Thus, virtually all operating states may be coded, using a simple arrangement.

According to a further exemplary refinement, the iron circuit of the ignition coil may be controlled up to the start of saturation, in an operating mode that requires a high initial spark current. Thus, more energy may be stored and the rate of increase of the voltage may be increased because of the lower, secondary inductance at the beginning.

DETAILED DESCRIPTION

Figure 1:
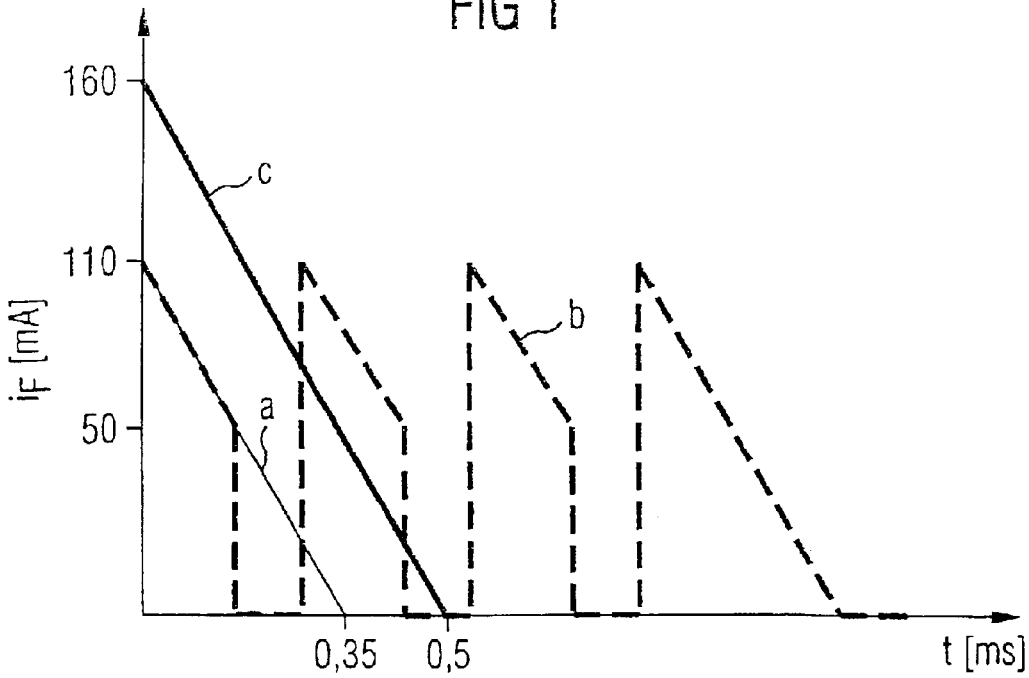
FIG. 1 shows a representation of the curve of spark current $i_F$ versus time t according to a first exemplary embodiment of the present invention.

FIG. 1 is a representation of the curve of spark current $i_F$ versus time t according to a first exemplary embodiment of the present invention.

In FIG. 1, curve a) represents the spark-current characteristic in the form of the discharge of the ignition coil (secondary energy approximately 30 mJ, primary interrupting current approximately 10 A), without the pulse-train characteristic. The initial, secondary-side spark current is approximately 110 mA with a spark duration of approximately 0.35 ms and a spark voltage of 1500 V.

Curve b) shows this ignition coil during the generation of a pulse train having four pulses, in which, in each case, the primary-side re-energization of the ignition coil occurs when the spark current has decreased to approximately 50 mA. A battery voltage of 42 V is assumed in order to realize the short recharging time.

In general, it should be mentioned that, in the case of a battery voltage of 14 V customary in conventional methods heretofore, the short recharging time may be achieved by increasing the primary current from 10 A to 30 A.

Curve c) shows the spark-current characteristic for homogeneous operation H1 or H2, namely when the coil is charged to approximately two times the energy, 60 mJ, by increasing the primary-side interrupting current (from approximately 10 A to 15 A).

This yields a spark duration of approximately 0.5 ms, given an initial current that is increased to approximately 160 mA.

This first exemplary embodiment assumes that the coil is in the linear range of the magnetizability.

Figure 2:
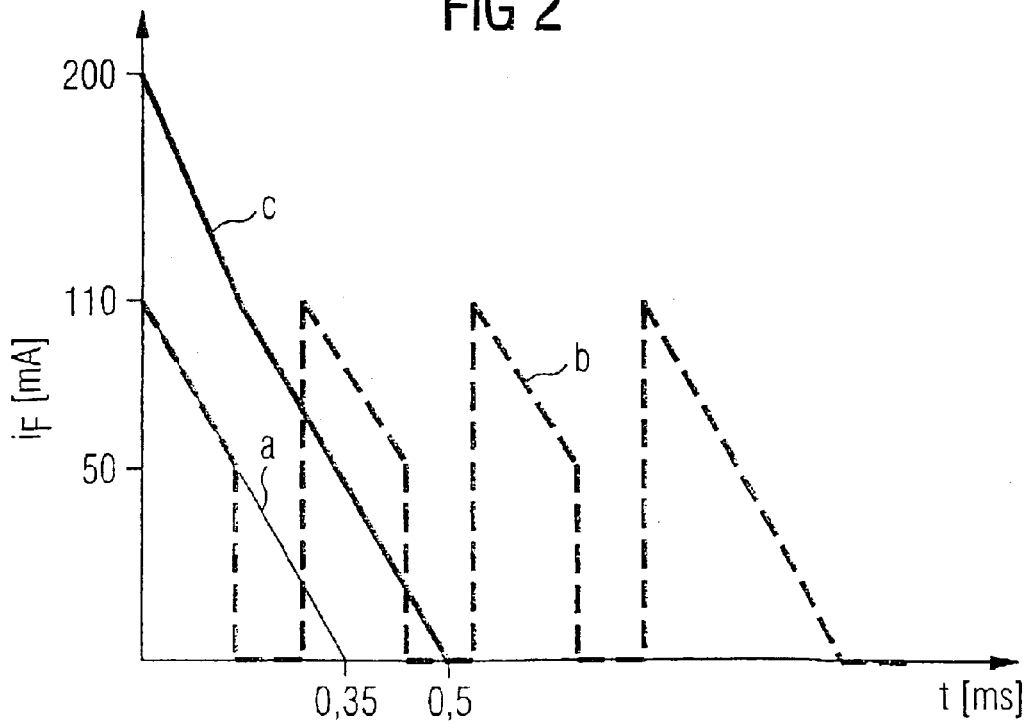
FIG. 2 shows a representation of the curve of spark current $i_F$ versus time t according to a second exemplary embodiment of the present invention.

FIG. 2 is a representation of the curve of spark current $i_F$ versus time t according to a second exemplary embodiment of the present invention.

In this second exemplary embodiment according to FIG. 2, it is assumed that, due to the limited space (bar coil), a linear increase in the magnetizability may no longer be achieved, but rather the nonlinearity of the magnetization is intentionally incorporated.

Curve a) represents the spark-current characteristic as the discharge of the ignition coil (bar coil, secondary energy approximately 30 mJ, primary interrupting current approximately 10 A), without the pulse-train characteristic. As in the first example mentioned above, the initial, secondary-side spark current is approximately 110 mA with a spark duration of approximately 0.35 ms.

As in the first example mentioned above, curve b) shows this ignition coil during the generation of a pulse train having four pulses, in which, in each case, the primary-side re-energization of the ignition coil occurs when the spark current has decreased to approximately 50 mA. In this case, a battery voltage of 42 V is likewise assumed in order to realize the short recharging time.

Curve c) shows the spark-current characteristic for homogeneous operation, namely when the coil is charged to approximately two times the energy, 60 mJ, by increasing the primary-side interrupting current (from approximately 10 A to 20 A). This yields an increased initial spark current of 200 mA, which decreases in a nonlinear manner, i.e. more steeply at the beginning, since a lower inductance is initially present on account of the saturation property. A sufficiently short spark duration of approximately 0.5 ms may also be obtained in this case.

This configuration may have two features. When space is limited (bar coil), more energy may be stored when the iron circuit is activated up to the start of saturation. The rate of increase of the voltage increases because of the lower, secondary inductance at the beginning. The increased rate of voltage increase may have a positive effect in the case of spark-plug shunting, i.e. carbon-fouled spark plugs (cold starting).

Figure 3:
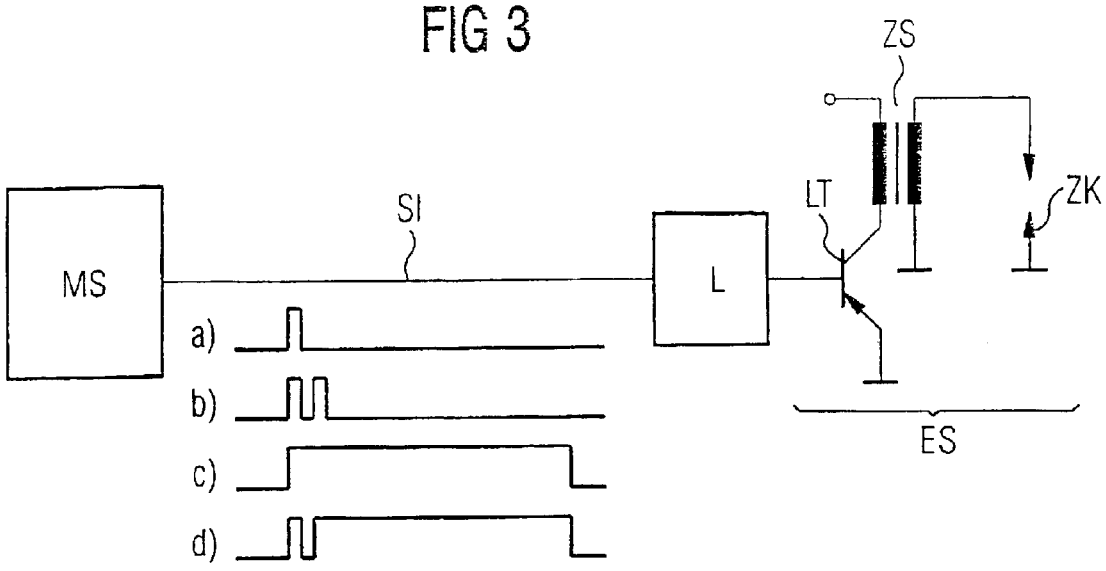
FIG. 3 shows a schematic representation of a control device for realizing the first and second exemplary embodiments.
Figure 4:
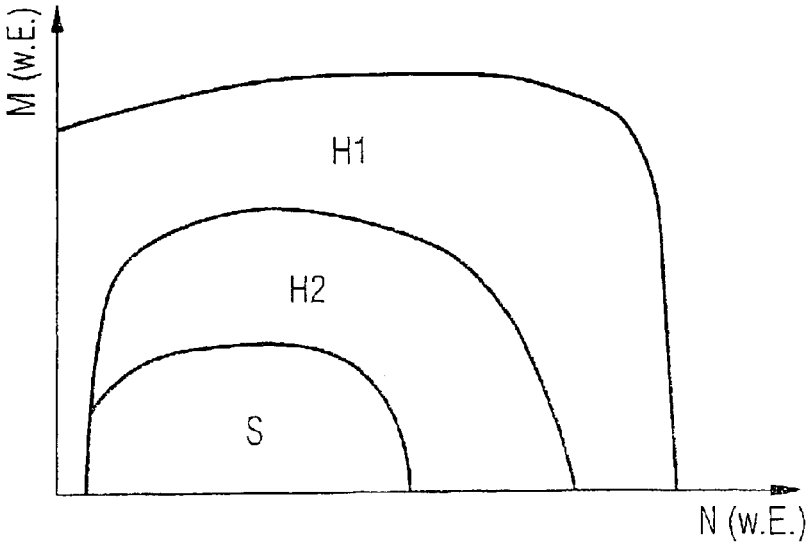
FIG. 4 shows the dependence of torque M on engine speed N for different operating modes of an internal combustion engine.

FIG. 3 shows a schematic representation of a control device for realizing the first and second, specific exemplary embodiments.

In particular, MS designates an engine control unit, L a control logic element, and ES an output stage, which includes a power transistor LT, a spark plug ZK, and an ignition coil ZS as fundamental components. It is assumed that the electronics which generate a pulse train, i.e. control logic element L and output stage ES, are arranged on/in ignition coil ZS.

A control pulse SI, which has a code from which control logic element L may locally recognize if a low-energy pulse train, a high-energy pulse train, a single, low-energy pulse, or a single, high-energy pulse is desired, is supplied by engine control unit MS as a function of the current injection mode.

FIG. 3 shows examples of suitable codes:

a) a single, short control pulse SI (approximately 10–100 $\mu$s): single 30 mJ spark during homogeneous operation with $\lambda$=1;

b) two short control pulses SI (each approximately 10–100 $\mu$s): single 60 mJ spark during homogeneous, lean-combustion operation, optionally with EGR;

c) a long control pulse SI (approximately 1–5 ms): pulse train base, 30 mJ, during stratified-charge operation;

d) a long control pulse SI (ca. 1–5 ms) after a short control pulse SI (approximately 10–100 $\mu$s): 60 mJ pulse train base during cold starting and/or maneuvering, or under other particularly critical engine conditions.

Although the present invention is described above on the basis of exemplary embodiments, it is not limited to them, but may be modified in a number of ways.

In particular, the present invention is not limited to the illustrated pulse shapes, energies, spark durations, and the like, but may be generalized as needed. Further injection modes or different injection modes may also be provided.

What is claimed is:

1. An ignition method for an internal combustion engine, comprising:

performing an injection alternatively one of in at least one first operating mode and in a second operating mode;

providing a control-pulse curve that is characteristic of a current operating mode;

loading an ignition coil with energy as a function of a primary current by a control logic element in response to the control-pulse curve; and using corresponding, different time characteristics of the primary current to produce ignition sparks, released by the ignition coil at a spark plug, differently for the at least one first operating mode and the second operating mode;

wherein:

the at least one first operating mode is a homogeneous, normal operation that is subdivided into submodes of a stoichiometric, normal operation and a sub-stoichiometric, normal operation and the second operating mode is an inhomogeneous, stratified-charge operation, the loading of the ignition coil during the inhomogeneous, stratified-charge operation is performed as a pulse-train ignition, using the primary current, and the loading of the ignition coil during the homogeneous, normal operation is performed as a single-pulse ignition with an increase in the primary current.

2. The ignition method according to claim 1, wherein the control-pulse curve characteristic of the current operating mode has at least one of different pulse times and different numbers of pulses.

3. The ignition method according to claim 1, further comprising:

controlling the ignition coil in an operating mode in which ignition sparks having a high initial spark current are required so that an iron circuit of the spark plug having a linear range of magnetizability is controlled up to a start of saturation of a magnetization.

4. An ignition device, comprising:

an ignition output stage;

a control logic element connected as an input to the ignition output stage; and an engine control unit for generating a control-pulse curve that is characteristic of a current operating mode;

wherein;

in response to the control-pulse curve, the control logic element is configured to adjust the ignition output stage to a corresponding time characteristic of a primary current;

at least one first operating mode is a homogeneous, normal operation that is subdivided into submodes of a stoichiometric, normal operation and a sub-stoichiometric, normal operation and a second operating mode is an inhomogeneous, stratified-charge operation, the loading of the ignition coil during the inhomogeneous, stratified-charge operation is performed as a pulse-train ignition, using the primary current, and the loading of the ignition coil during the homogeneous, normal operation is performed as a single-pulse ignition with an increase in the primary current.

5. The ignition device of claim 4, wherein the control-pulse curve characteristics of the current operating mode has at least one of different pulse times and different numbers of pulses.

6. The ignition device of claim 4, wherein the ignition coil is controlled in an operating mode in which ignition sparks having a high initial spark current are required so that an iron circuit of the spark plug having a linear range of magnetizability is controlled up to a start of a magnetization.

* * * * *